US005727781A

United States Patent [19]

Müller

[11] Patent Number: 5,727,781

[45] Date of Patent: Mar. 17, 1998

[54] PROCESS AND APPARATUS FOR COMBINING PRINTED PRODUCTS

[75] Inventor: Erwin Müller, Dürnten, Switzerland

[73] Assignee: Ferag AG, Hinwil, Switzerland

[21] Appl. No.: 752,206

[22] Filed: Nov. 19, 1996

[30] Foreign Application Priority Data

Nov. 21, 1995 [CH] Switzerland ..... 03292/95

[51] Int. Cl.[6] ..... B65H 39/02; B65H 5/22

[52] U.S. Cl. ..... 270/58.23; 270/58.29; 271/3.14; 271/9.13; 271/285

[58] Field of Search ..... 270/58.01, 58.23, 270/58.29, 58.31; 271/3.14, 3.18, 3.19, 9.13, 285, 286, 184

[56] References Cited

U.S. PATENT DOCUMENTS

| | | | |
|---|---|---|---|
| 4,234,178 | 11/1980 | Becker et al. | 270/58.01 X |
| 4,471,953 | 9/1984 | Reist et al. . | |
| 4,625,954 | 12/1986 | Pusey | 270/58.23 X |
| 4,795,143 | 1/1989 | Tsai | 270/58.01 X |
| 5,088,711 | 2/1992 | Newsome . | |
| 5,106,070 | 4/1992 | Reist . | |
| 5,112,041 | 5/1992 | Honegger . | |
| 5,399,222 | 3/1995 | Reist . | |
| 5,433,430 | 7/1995 | Straessler et al. | 271/286 X |

FOREIGN PATENT DOCUMENTS 1254581 11/1967 Germany .

*Primary Examiner*—Hoang Nguyen

*Attorney, Agent, or Firm*—Bell Seltzer Intellectual Property Law Group of Alston & Bird LLP

[57] ABSTRACT

A process and apparatus for combining printed products of a plurality of types to form sets having products of each type. The first type of products are arranged in an imbricated formation in which they overlap one another in a first conveying direction and the edges run obliquely with respect to the first conveying direction. Products of another type are then deposited on the first products successively with the same alignment. Subsequent types of products may be similarly assembled to form the set of products. The formed sets having one of each type of products are then separated and conveyed in a further conveying direction which is angularly displaced from the first conveying direction.

12 Claims, 3 Drawing Sheets

PROCESS AND APPARATUS FOR COMBINING PRINTED PRODUCTS

FIELD OF THE INVENTION

The present invention relates to a process and apparatus for combining printed products of different types to form sets having a product of each type.

BACKGROUND OF THE INVENTION

A process and an apparatus of this type are disclosed in German Application No. 1,254,581. The prior apparatus has a conveying device with drivers which are arranged on two parallel conveying chains and are driven in circulation in the conveying direction. The drivers are located opposite one another at right angles to the conveying direction. In the region of the upper, active strand of the conveying chains, the drivers engage the longitudinal slots of a top metal plate which are arranged above the conveying chains and which run in the conveying direction. Above the conveying device, a plurality of feeder units are arranged one behind the other and are intended for discharging, sequence the drivers which are driven in circulation, one sheet-like printed product of the type assigned to them.

A product of the first type, which is discharged from the first feeder unit as seen in the conveying direction, is taken up by a pair of drivers and, lying on the top metal plate, is pushed beneath the next feeder unit, where a printed product of the second type, which is discharged from the next feeder unit, is likewise carried along. The printed products of further types, which are discharged from the following feeder units, are carried along in the same manner, with the result that they ultimately form a set which has a product of each type. The sets which are formed in this manner are transported away from the conveying device into a stack shaft by means of a pair of conveying rollers. The distance between the drivers is greater than the format of the printed products as measured in the conveying direction, so that individual sets of products are formed. If the processing capacity of such an apparatus is to be increased, this necessitates an increase in the circulating speed of the drivers. However, the risk of damaging the products when the drivers strike against them goes against a high circulating speed. As a result, the processing capacity of the prior apparatus has relatively modest upper limits. Furthermore, the known apparatus requires a considerable overall length because the distance between successive feeders has to be greater than the format of the products as seen in the conveying direction and, in addition, the supply magazines of the feeders extend in the conveying direction, which results in difficult operation.

A further process and a further apparatus for combining printed products of different types to form sets having a product of each type are disclosed in Germany Patent DE-A-31 45 491 and the corresponding U.S. Pat. No. 4,471,953. The prior apparatus has a conveying device having spaced-apart drivers which are driven in circulation in the conveying direction and feed devices arranged one behind the other. These have controllable grippers which are likewise arranged one behind the other, run through a discharge region above the conveying device, and have a feed direction which is essentially in the same direction as the conveying direction. The feed devices are driven at a lower speed than the conveying device, in order to bring the trailing edge of the products which are fed by the feed devices into the active region of the clamps of the conveying device. Each feed device discharges a product to each clamp in this manner, the clamps being designed for raising products retained by the respectively following clamp to permit the trailing edge of the products to be fed to run into the respective clamp. This thus forms sets which have one of each type of product and then which are transported away in a manner in which they are retained individually by means of the clamps. Since, in the case of this known apparatus, the products are transported by means of clamps and since they overlap one another in an imbricated manner, a high processing capacity with careful treatment of the product is ensured. However, the space requirement is not inconsiderable and the conveying device, designed as a clamp-type transporter, requires a certain amount of structural outlay.

SUMMARY OF THE INVENTION

It is an object of the present invention to provide an apparatus and process for combining printed products of different types to form sets having a product of each type wherein careful treatment of the products is ensured and considerable processing capacities result.

According to the invention, the products of the first type are conveyed in an imbricated formation. As a result of overlapping of the products, at a certain processing capacity, the speed of the conveying device is considerably lower than the speed would have to be if the products were processed without mutual overlapping. The low speed results in careful treatment of the products. The products of the further or second types are deposited in the same alignment as the products of the first type, on the products of the first type, i.e. the products of each further type thus form, once again, an imbricated formation as long as the format thereof if not considerably smaller than the format of the products of the first type. Since the speed of the conveying device can be kept low, it is easily possible, with careful treatment of the products, to separate from one another the products of successive sets which engage one inside the other as a result of the imbricated formation, with the result that the products of the separated sets then rest flatly against one another.

The oblique position of the products with respect to the conveying direction permits, a compact construction and action on the products at different locations for ensuring that the products are deposited one upon the other in an aligned manner or for separating the sets of products.

BRIEF DESCRIPTION OF THE DRAWINGS

The invention will now be described in more detail with reference to an exemplary embodiment which is illustrated in the drawing, in which, purely schematically.

DETAILED DESCRIPTION OF THE PREFERRED EMBODIMENTS

Figure 1:
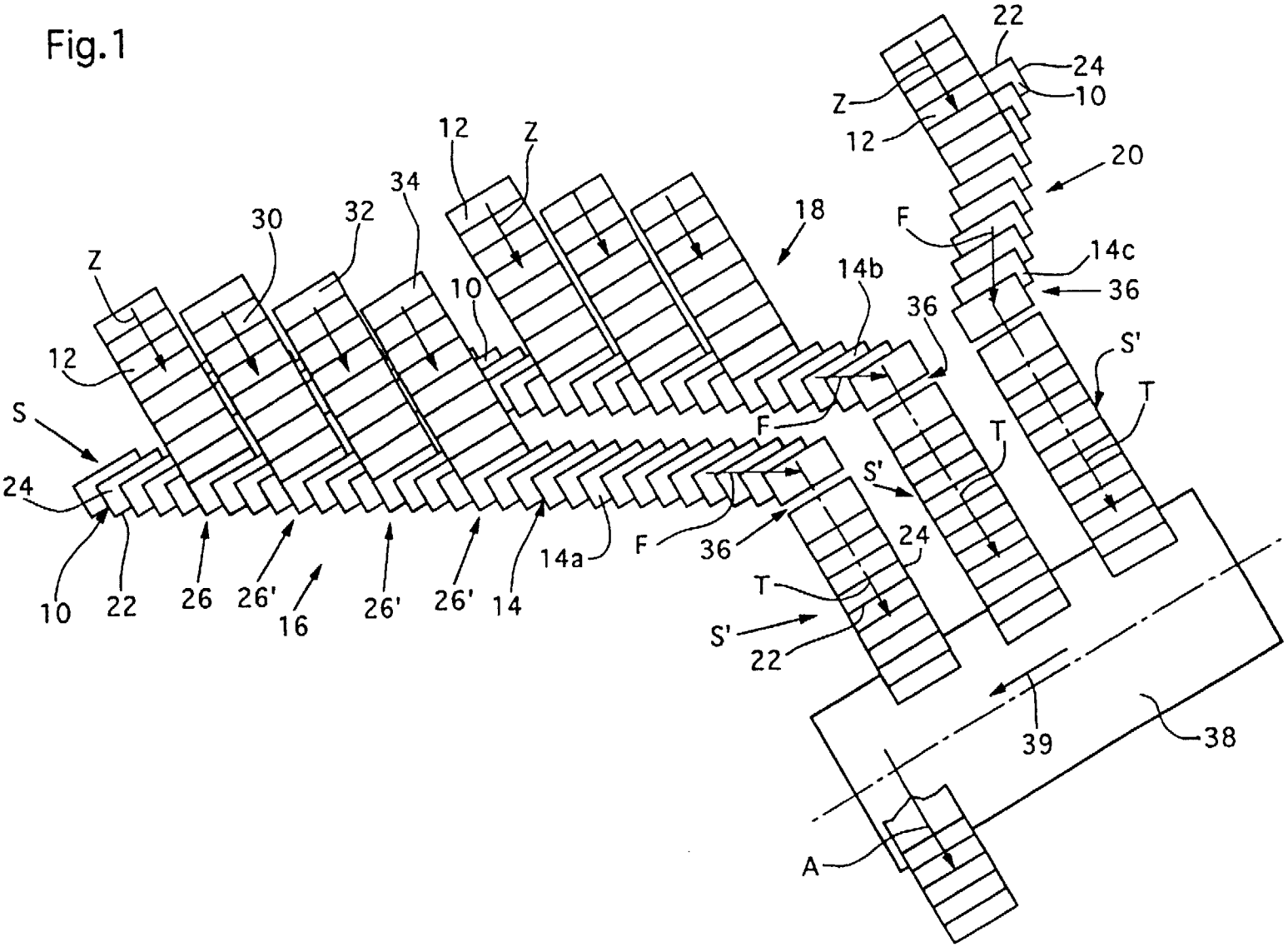
FIG. 1 is a plan view of products during processing by the process according to the invention and with an apparatus according to the invention, and of a further-processing station to which the sets formed from the products are fed.

FIG. 1 shows, schematically, the operation of combining products of the first type 10 at least with products of a second type 12 to form sets 14 which have one of the products of each type in the correct order. While a finite number of different types of products are shown in the figures, it is to be understood that the apparatus and process of the present invention may be employed to assemble any number of different types of products and is not limited to the number shown. The products are combined by means of an apparatus as illustrated schematically in FIGS. 2 to 4. As can be seen from FIG. 1, three apparatuses 16, 18, 20 are shown there, by means of which different sets 14*a*, 14*b* and 14*c* are formed from, in each case, one product of the first type 10 and one product of a second type 12 and, if appropriate, of products of further types.

By means of the first apparatus 16, the products of the first type 10, which are arranged in an imbricated formation S, are conveyed in the conveying direction F. In the imbricated formation S, each product of the first type 10 rests on the respectively following product as seen in the conveying direction F. The adjoining edges 22, 24 of the essentially rectangular products 10, 12 run oblique with respect to the conveying direction F. In the example shown, the longer edges 22 and the shorter edges 24 enclose an angle of approximately 30° and of approximately 60°, respectively, with the conveying direction F.

At a first discharge location 26, each product of the first type 10 which is moved past the first discharge location 26 has deposited on it, with the same alignment as the product of the first type 10, a product of the second type 12. The feed direction of the products of the second type 12 are designated by "Z". At three further discharge locations 26', which are arranged downstream of the discharge location 26 as seen in the conveying direction F, a product of the third type 30, a product of the fourth type 32, and a product of the fifth type 34 are deposited in the same manner, with the result that each set 14*a* has a product of each type.

For the sake of completeness, it should be mentioned that products of the first, second, third and fourth type 12, 30, 32, 34 are fed to the discharge locations 26, 26' in an imbricated formation in which each product rests on the respectively following product.

At the leading end 36 of the imbricated formation S as seen in the conveying direction F, the products 10, 30, 32, 34 which form a set 14*a* in each case are separated from the following set 14*a* in the separating direction T. The latter runs at right angles to the edge 22 in the example shown, in a manner corresponding to the oblique position of the products of the first type 10.

The sets 14*a* which are separated off one after the other are then fed in an imbricated formation S' to a further-processing machine 38 in a removal direction which corresponds to the separating direction T. In this imbricated formation S', each set 14*a* of products then rests in an imbricated manner on the respectively preceding set 14*a*, the longer edges of the products 10, 12, 30, 32, 34 running at right angles to the separating direction T and the shorter edges 4 being aligned one upon the other.

In the same manner, the apparatus 18 forms sets 14*b* from products of the first type 10, products of the second type 12, products of the third type 30 and products of the fourth type 32, these sets, once again, having in each case one product of each of these types in the correct order. Here too, the set 14*b* which is arranged in each case at the leading end 36 of the imbricated formation S is separated from the following set in the separating direction T, and the separated-off set 14*b* is then deposited in an imbricated manner on the preceding set 14*b* as seen in the separating direction T, as a result of which they are also fed to the further-processing machine 38 in an imbricated formation S'.

In the same manner, the third apparatus 20 deposits, on products of the first type 10 which are arranged in an imbricated formation S, products of the second type 12, with the same alignment, to form sets 14*c*. Here too, however, the set 14*c* which is arranged at the end 36 of the imbricated formation S in each case is separated in the separating direction T running at right angles to the longer edge 24. The sets 14*c* which are separated off one after the other are arranged to form an imbricated formation S' and, in this formation, are likewise fed to the further-processing machine 38. The latter is designed, for example, in the manner of a drum and serves to collate the sets 14*a*, 14*b* and 14*c* while it turns, as is indicated by the arrow 39. The collated sets are then transported away in groups, as is indicated by the arrow A.

In the example shown, the products are printed products, such as portions of a newspaper or periodical. The products of the different types thus do not differ in format, although they probably do differ with regard to the information printed on them and, possibly, the page number.

Figure 2:
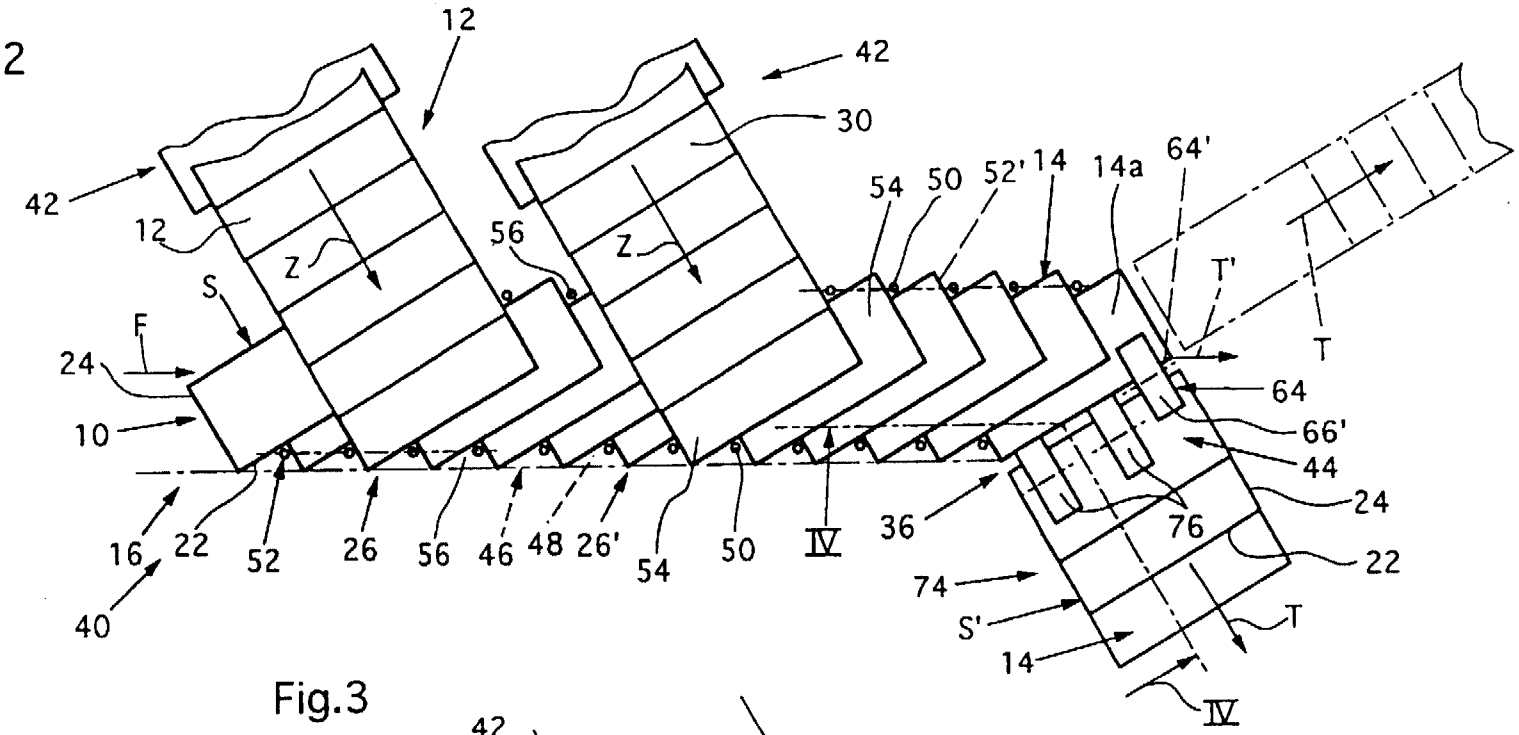
FIG. 2 is a plan view of the apparatus according to the invention with printed products during processing.
Figure 3:
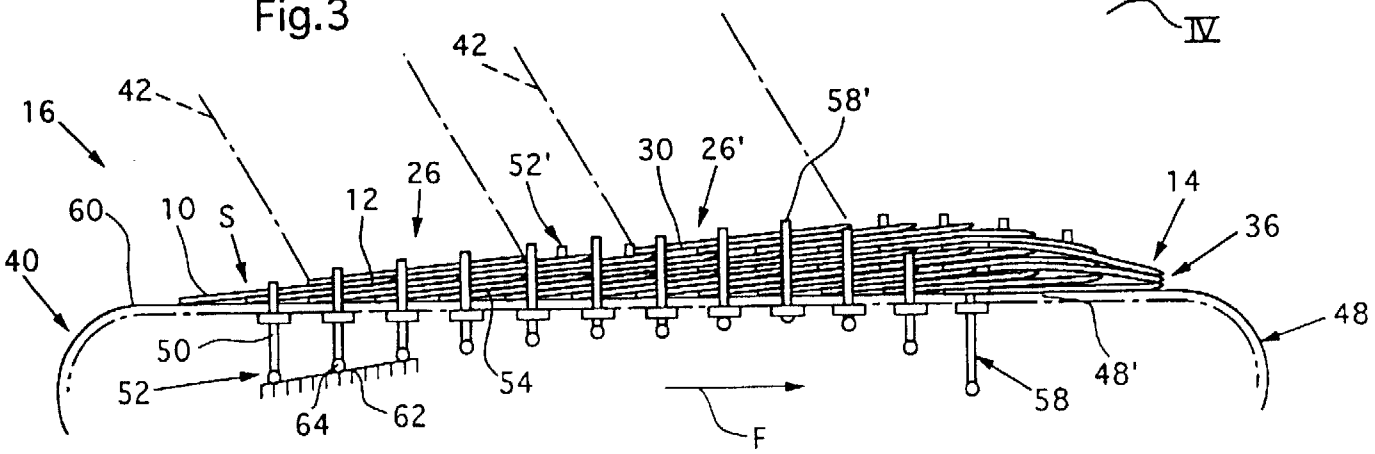
FIG. 3 is a view of the apparatus shown in FIG. 2.
Figure 4:
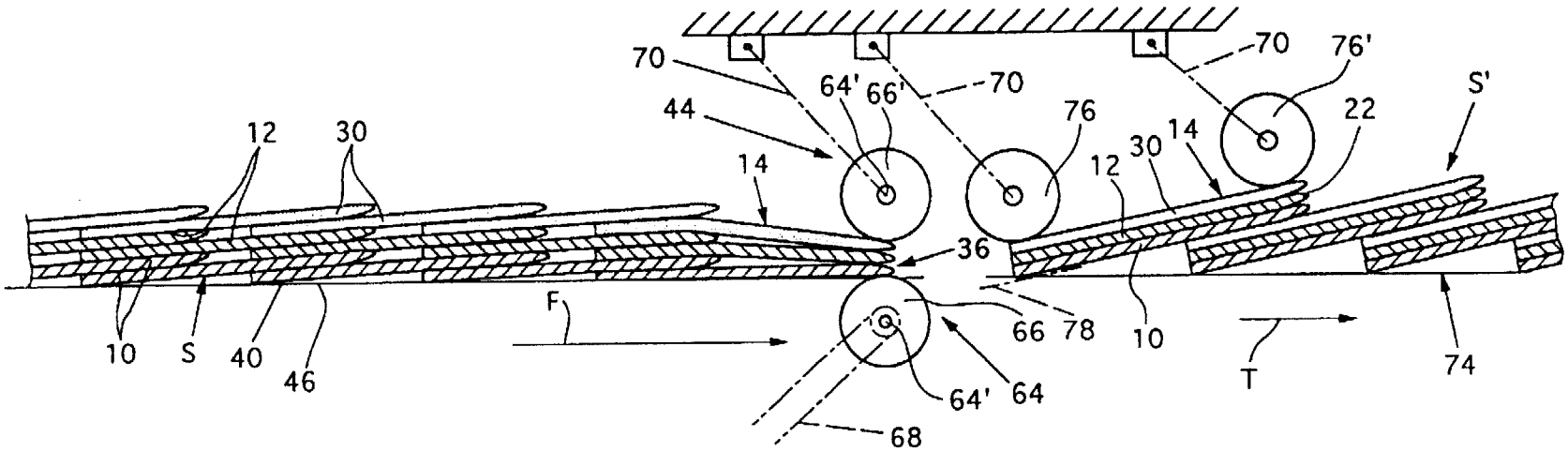
FIG. 4 is the apparatus in a vertical section along line IV—IV of FIG. 2.

The apparatuses 16, 18, 20 each have a conveying device 40, a feed device 42 and a separating device 44, as is shown in FIGS. 2 to 4. The conveying device 40 is designed as a belt conveyor 46 on whose conveying belt 48 bar-like drivers 50 are arranged, in two parallel rows 52, 52', at a distance one behind the other as seen in the conveying direction F. The distance between the two rows 52, 52' of drivers 50 and the offset in the conveying direction of the drivers 50 of one row 52 with respect of those of the other row 52' is selected to correspond to the format of the products of the first type 10 and their oblique position with respect to the conveying direction F, such that in each case lateral corner regions 54 of a product 10 as seen in the conveying direction F are arranged between two successive drivers 50. In other words, the drivers 50 engage in triangular or sawtooth-like clearances 56 which are formed by successive products 10 as a result of the oblique position. Consequently, the position of the products of the first type 10 is precisely defined and the products of the further type 12 which are deposited thereon are aligned.

The drivers 50 are mounted displaceably in their longitudinal direction. In the rest position 58, they are lowered beneath the carrying and conveying surface 60 of the conveying belt 48, as seen in the region of the active strand 48'. By means of a control device 62, which is designed, for example, as a guide interacting with follow-on members 64 of the drivers 50, the drivers 50 are raised, in a section of the active strand 48' of the conveying belt 48, beyond the surface 60 into an operating position 58' in order to serve as stops and thus carry out the aligning and carry-along function. If the separating direction T runs obliquely with respect to the conveying direction F, as is shown in FIGS. 1 and 2, it may be appropriate for that driver 50 which directly follows the set 14*a*, 14*b*, 14*c* to be separated off and which belongs to the row 52, 52' facing the separating operation, the row 52 in FIG. 2, to be moved into the rest position 58 before the separating device 44 acts on the relevant set 14*a*, 14*b*, 14*c*.

In the case of the embodiment shown in FIGS. 2 and 3, the feed devices 42 are designed as belt conveyors which are intended for feeding the products of the second type 12 and of the third type 30 in an imbricated formation to the relevant discharge locations 26 and 26', in which each product 12 rests on the preceding product in each case as seen in the feed direction Z. The foremost product 12 of the relevant imbricated formation which is released in each case by a conveying device 40 drops onto the associated product of the first type 10 or onto the already deposited product of the second type 12 between the relevant four drivers 50, this ensuring a reliable carry-along operation in the conveying direction F along with simultaneous alignment. Of course, the feed devices 42 are driven in time with the conveying device 40 and feed devices 42 are aligned in accordance with the oblique position of the products of the first type 10, in order to ensure that the products of the first type 10 and products of the second and third further types 12, 30 are deposited one on top of the other in a congruent manner.

As can be seen, in particular, from FIGS. 3 and 4, imbricated formations are likewise formed on the conveying device 40 from the products of the second and third types 12, 30, and these imbricated formations are of the same type as the imbricated formation S of the products of the first type 10. In FIG. 4, the products of the first type 10 are marked by a hatching which runs from the bottom left to the top right, the products of the second type 12 which are located directly thereon are marked by a hatching which runs from the bottom right to the top left, and the products of the third type 30 which are located on the products of the second type 12 are marked by dots. It can likewise clearly be seen that the products of each type form an imbricated formation which rests on the imbricated formation located therebeneath, without the products belonging to one imbricated formation engaging between products of an adjacent imbricated formation.

It can be seen from FIGS. 2 and 4 together that the separating device 44 arranged at the downstream end of the conveying device 40 as seen in the conveying direction F has a pair of accelerating rollers 64 whose axes of rotation 64' run in a manner corresponding to the oblique position of the products of the first type 10, parallel to the longer edge thereof. Of the pair of accelerating rollers 64, the lower roller 66 is connected to a drive motor via a chain drive 68. The upper roller 66' serves as a weighting roller and is mounted on the machine framework 72 via a weighting lever 70 which is mounted in a freely pivotable manner. The pair of accelerating rollers 64 forms a conveying nip into which the set **14*a* which is arranged at the downstream end 36 as seen in the conveying direction F in each case is introduced by means of the conveying device 40. The circumferential speed of the pair of accelerating rollers 64 is coordinated with the conveying speed of the conveying device 40 and the imbricated formation S such that the respectively relevant set 14*a* is transported away to the full extent from the region of the conveying device 40, and thus of the imbricated formation S, before the next set 14*a* runs into the active region of the pair of accelerating rollers 64. In other words, the sets 14*a* are separated one after the other by means of the relevant separating devices 44, with the result that the products 10, 12, 30 forming a set 14*a*** are located one on top of the other such that they are aligned flatly one on the other in the manner of a stack.

A removal conveyor 74 which is designed as a belt conveyor is arranged downstream of the separating device 44 as seen in the separating direction T. Interacting with the initial region of the removal conveyor 74 are two rollers 76, 76' which are arranged above the said removal conveyor, are likewise mounted on the machine framework 72 via weighting levers 70 and serve as press-on rollers and braking rollers in order to brake to the speed of the removal conveyor 74 the sets **14*a* accelerated by means of the separating device 44. Furthermore, a directing plate 78 is arranged beneath the roller 76 in order to direct the leading end, as seen in the separating direction T, of the separated-off set 14*a* over the trailing end of the directly preceding set. Since the conveying speed of the removal conveyor 74 corresponds approximately to the conveying speed of the conveying device 40, the imbricated formation S' is thus formed from the separated-off sets 14*a* by each set 14*a* resting on the respectively preceding set and the longer edges of the products running at right angles to the separating direction T and the shorter, then laterally arranged, edges 24 being aligned one upon the other. The formation of an imbricated formation S' means that the sets 14*a* formed can be processed by means of further-processing machines 38**.

As is indicated by chain-dotted lines in FIG. 2, it is also conceivable to select the separating direction T to be at right angles to the shorter edge 24. However, it is also possible, in principle, for the separation to take place in other directions, in the conveying direction F, as is indicated by the arrow T'.

The feed devices 42 may also have feeder units which are known in general. Feeder units as are known from EP-A-0 417 503 and the corresponding U.S. Pat. No. 5,106,070, which are incorporated herein by reference, are particularly suitable. Such feeders can be used, for example, also to form the imbricated formation S from the products of the first type 10.

It is not necessary for the belt conveyor 46 to have drivers 50. The only thing which has to be ensured is that the products of the second type 12 and of the further types are deposited on the products of the first type 10 such that sets of products can be separated.

It is, of course, not necessary for all the products to be of the same format. However, it is likely to be expedient if the products of the largest format form the products of the first type 10.

Of course, it is also conceivable to form an imbricated formation in each case from the products of the second type 12 and from the products of each further type and then to deposit these imbricated formations one after the other on the imbricated formation S of the products of the first type 10.

While particular embodiments of the invention have been described, it will be understood, of course, the invention is not limited thereto since modifications may be made by those skilled in the art, particularly in light of the foregoing teachings. It is therefore, contemplated by the appended claims to cover any such modifications that incorporate those features of these improvements in the true spirit and scope of the invention.

That which is claimed:

1. A process for combining printed products of at least first and second types to form sets having products of each type comprising the steps of:

arranging the first type of products one behind the other to form a first imbricated formation in a first conveying direction wherein the first type of products which follow one after the other overlap one another and edges of the first type of products are obliquely arranged with respect to the first conveying direction;

conveying the first type of products in the first imbricated formation along the first conveying direction; and depositing the second type of products successively on each product of the first type and aligning the second type of products so as to correspond with the oblique arrangement of the first type of products; and separating the formed sets of the first imbricated formation.

2. The process as claimed in claim 1, wherein the sets of products which are separated from the first imbricated formation are arranged for further conveying in a second conveying direction, in a second imbricated formation in which edges of the products of the sets are perpendicular to the second conveying direction and are aligned with one another.

3. The process as claimed in claim 2, wherein the sets of products which are separated from the first imbricated formation are each further conveyed in an oblique position with respect to the first conveying direction.

4. The process as claimed in claim 1, wherein the sets of products which are separated from the first imbricated formation are conveyed further in a second conveying direction which substantially corresponds to the oblique arrangement of the products of the first type of products in the first imbricated formation.

5. The process as claimed in claim 4, wherein the sets which are formed are separated from following sets in the second conveying direction which substantially corresponds to the oblique arrangement of the products in the imbricated formation.

6. An apparatus for combining printed products of at least first and second types to form sets having a product of each type comprising:

a conveying device for conveying said first type of products in an imbricated formation wherein one product is positioned behind another in a conveying direction wherein each of said first type of products are arranged in an oblique position with respect to the conveying direction;

at least one feed device for the second type of products having a discharge location for sequentially depositing said second type of products onto a respective one of said first type of products which are conveyed past said discharge location, said feed device being positioned such that the second type of products are deposited in an oblique position corresponding to the oblique position of the first type of products to form said sets; and a separating device positioned downstream in the conveying direction from said at least one feed device for separating the formed sets from one another.

7. The apparatus as claimed in claim 6, further comprising a removal conveyor arranged downstream from said separating device having a removal direction which substantially corresponds to the oblique position of the products of the first type of products arranged on the conveying device.

8. The apparatus as claimed in claim 7, wherein the separation device comprises conveying rollers having axes of rotation which substantially correspond to the oblique position of the products of the first type on the conveying device.

9. The apparatus as claimed in claim 6, wherein the conveying device includes two parallel rows of drivers which are driven in circulation in the conveying direction for engaging triangular clearances formed as a result of the oblique position of successive products.

10. The apparatus as claimed in claim 9, wherein the conveying device comprises a belt conveyor which supports the drivers.

11. The process as defined in claim 1 wherein the depositing step includes advancing the second type of products in a second imbricated formation along a depositing direction, such that the second type of products in the second imbricated formation define leading edges which are perpendicular to the depositing direction and parallel to opposite edges of the first type of products in the first imbricated formation.

12. The apparatus according to claim 6 wherein said at least one feed device advances the second type of products in a second imbricated formation along a depositing direction such that the second types of products in the second imbricated formation define leading edges which are perpendicular to the depositing direction and parallel to opposite edges of the first type of products in the first imbricated formation.

* * * * *